US005280693A

United States Patent [19]

Heudecker

[11] Patent Number: 5,280,693

[45] Date of Patent: Jan. 25, 1994

[54] VESSEL CLOSURE MACHINE

[75] Inventor: Gerhard Heudecker, Pentling-Poign, Fed. Rep. of Germany

[73] Assignee: Krones AG Hermann Kronseder Maschinenfabrik, Neutraubling, Fed. Rep. of Germany

[21] Appl. No.: 957,371

[22] Filed: Oct. 7, 1992

[30] Foreign Application Priority Data

Oct. 14, 1991 [DE] Fed. Rep. of Germany ... 9112761[U]

[51] Int. Cl.[5] ..... B67B 3/06; B65B 7/28

[52] U.S. Cl. ..... 53/306; 53/343

[58] Field of Search ..... 53/308, 306, 303, 343

[56] References Cited

U.S. PATENT DOCUMENTS

| | | | |
|---|---|---|---|
| 3,643,398 | 2/1972 | Quest et al. | 53/306 X |
| 3,683,588 | 8/1972 | Ahlers | 53/308 X |
| 3,714,760 | 2/1973 | Roberts et al. | 53/308 X |
| 5,157,897 | 10/1992 | McKee et al. | 53/308 |

*Primary Examiner*—Horace M. Culver

*Attorney, Agent, or Firm*—Finnegan, Henderson, Farabow, Garrett & Dunner

[57] ABSTRACT

A vessel closure apparatus with a stripping magnet for unprocessed crown caps disposed before a cap feeding device relative to the revolving direction of a closure head. The stripping magnet is located below the revolving path of the closure heads and has a greater magnetic attraction for the crown cap than the magnet used to hold the crown cap in the closure head.

14 Claims, 1 Drawing Sheet

VESSEL CLOSURE MACHINE

BACKGROUND OF THE INVENTION

1 Field of the Invention

Figure 2:
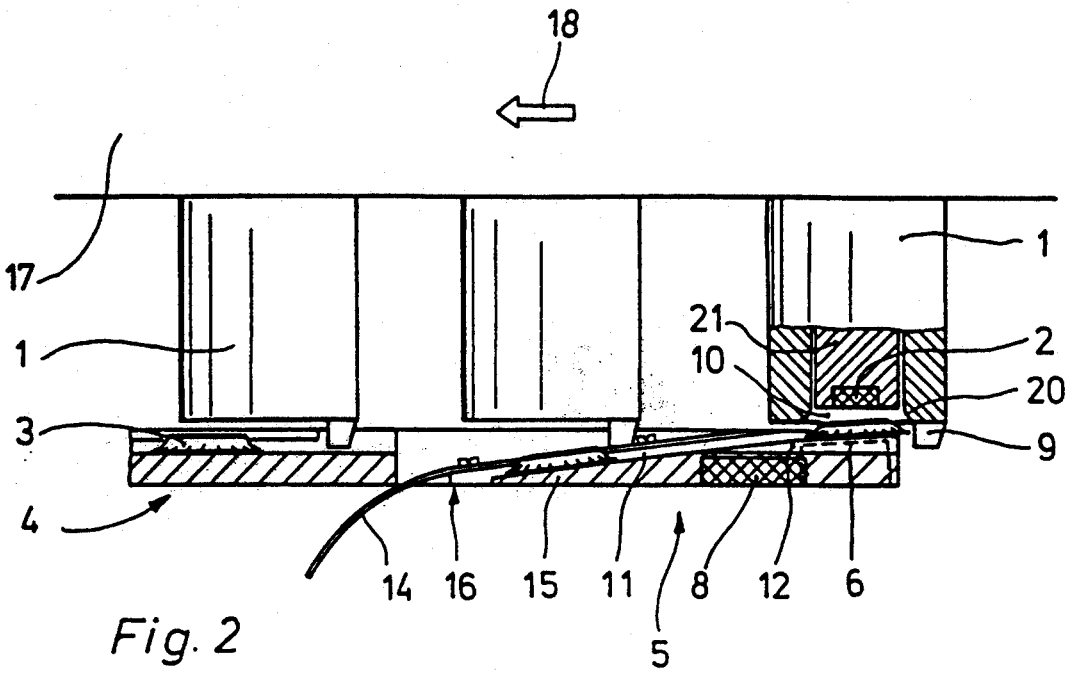

The invention relates to a vessel closure apparatus.

2. Description of the Prior Art

Vessel closure apparatus are already known in which U-shaped, outwardly open pockets for the crown caps are formed at the lower side of the closure heads, from which the crown caps held in the ejector by a permanent magnet only project slightly downwardly (DE-GM 1 947 169). The stripping means has a stationary edge extending obliquely outwardly and disposed closely below the pockets. Remaining bottles which get caught in the closure heads can be discharged by means of the oblique edge. However, the removal of unprocessed crown caps is extremely problematical due to the slight projecting portion so that malfunctions due to crown caps fed doubly or getting hooked in the area of the feeding means cannot be excluded.

In another vessel closure apparatus the crown caps supported by a permanent magnet in the ejector again project with respect to the lower front side of the closure heads with their full height so that unprocessed crown caps can be removed by a stationary stripping edge aligned radially to the revolving path and can be introduced into a downwardly extending discharge duct (DE-PS 27 40 440). However, the insufficient fixing and carrying along of the crown caps both in the area between the feeding means and the closure zone and between the closure zone and the stripping means is disadvantageous.

SUMMARY OF THE INVENTION

The present invention is based on the object of improving the effect of the stripping means with simple means in a vessel closure apparatus that unprocessed crown caps or the like not projecting or only slightly projecting with respect to the lower side of the closure heads can be removed reliably and in trouble-free fashion from the closure heads.

This object is attained according to the invention as follows.

A mechanical contact between the unprocessed crown caps and a stripper edge or the like is not necessary in the vessel closure apparatus of the present invention. The crown caps are removed from the closure heads by magnetic stripping means which has a magnetic attraction for the crown caps greater than the magnetic attraction of the magnet holding the crown caps in the closure head. This also applies if the crown caps do not or only slightly project downwardly with respect to the lower front side of the closure heads.

In the most simple case a strong magnet is sufficient which is disposed at a sufficient distance below the movement path of the closure heads so that it can receive a certain number of crown caps. It must then be manually freed from the accumulated crown caps every once in a while. It is also conceivable to use several magnets revolving synchronously to the closure heads on a closed path, each of which being able to remove respectively one crown cap from a closure head. The crown caps can then be removed from the revolving magnets by means of a stationary stripper.

It is especially expedient if the closure heads themselves are used for the transport and the centering of unprocessed crown caps. Due to this embodiment a trouble-free transport of the unprocessed crown caps from the closure area to the stripping means is ensured. Also, the possibility is provided in simple fashion to ensure a reliable discharge of the crown caps pulled off by means of several stationary magnets and a stationary sliding path. Additional embodiments of the present invention will be described below.

An example of an embodiment of the invention is described by means of the drawings.

Figure 1:
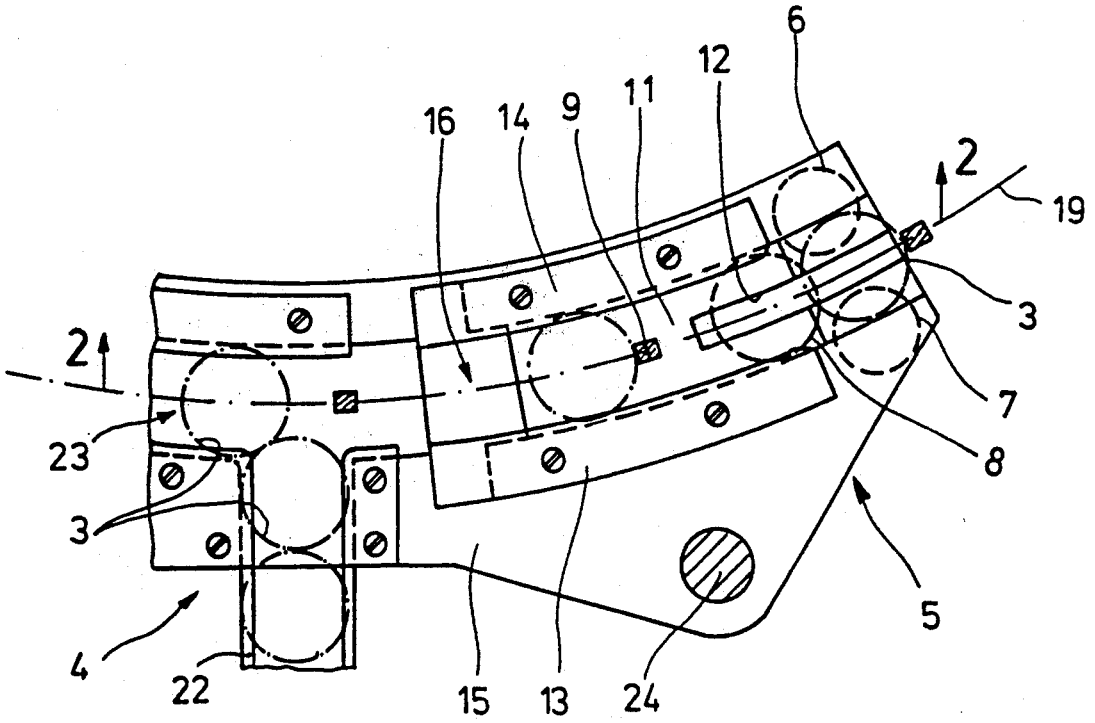

FIG. 1 shows a top view of a vessel closure machine in the area of the feeding and stripping means for the crown caps, the closure heads being omitted, and FIG. 2 shows the section A-B according to FIG. 1.

A vessel closure apparatus is represented partially in FIGS. 1 and 2 and is adapted for the closing of beverage bottles (not shown) with metallic, magnetically influenceable crown caps 3. It has a drum-shaped rotor 17 with vertical axis of rotation, at whose circumference several closure heads 1 controlled in vertically movable fashion are disposed in uniform distribution. If the rotor 17 continuously rotates in the direction of the arrow 18, the closure heads 1 aligned vertically describe a circular revolving path 19.

As shown by FIG. 2 each closure head 1 has a rotational-symmetrical closure cone 20 at its lower side, in whose interior a cylindrical ejector 21 is resiliently mounted vertically movably. The ejector 21 is provided with a holding magnet 2 for a crown cap 3 at its lower horizontal front side. The lower front side of the ejector 21 is located somewhat higher in its lower end position than the lower front side of the closure cone 20 of the closure head 1. Due to this, a recess 10 is formed which completely receives the crown cap 3 fixed by the holding magnet without it projecting downwardly. A downwardly projecting, cam-shaped carrier 9 is formed at the rear side of each closure head, which points contrary to the revolving direction of the closure heads 1. Carrier elements 9 are located centrally to the revolving path 19 and are substantially more narrow than a crown cap 3 in their dimension transversely to the revolving direction. Due to the recess 10 an exactly centered cap seat is ensured, while a positive-locking, reliable transport of crown caps by the carrier element 9 is possible at any optional point of the revolving path.

The vessel closure apparatus according to FIGS. 1 and 2 comprises also a feeding means 4 for the crown caps 3, in which the crown caps fed in a slide (22) are moved by means of transport elements (not shown) in a duct 23 from where they are taken away by the carrier elements 9 and introduced into the recesses 10 with the cooperation of the holding magnets 2. The closure heads 1 thus fitted with crown caps move to the closure zone (not shown), where the crown caps 3 are pressed against the bottle openings and flanged by a controlled lowering of the closure heads 1. Subsequently, the closure heads 1 in general travel back empty to the feeding means 4 where they are again fitted with crown caps 3.

A stripping means 5 is disposed directly before the feeding means 4 positioned in the revolving direction of the closure heads for crown caps 3 which were not processed in the closure zone, e.g., due to the lack of corresponding bottles, which consequently travel back in the direction of the feeding means 4. The stripping means 5 comprises a horizontal plate 15, in which the feeding means 4 is also integrated and which is removably affixed to the stationary upper part (not shown) of the vessel closure machine by two vertical columns 24.

An arcuate, groove-shaped sliding way 11 is provided in the plate 15 concentrically and centrically to the revolving path 19, whose width is slightly greater than the diameter of a crown cap 3. The sliding way 11 is inclined slightly obliquely downwardly in the revolving direction of the closure heads 1. The initial area of the siding way 11 located at a higher level and whose length corresponds approximately to the cap diameter is disposed at a small distance below the revolving path of the closure heads 1 and inclined slightly less than the adjoining area. The sliding path 11 is provided with a groove-shaped recess 12 in the revolving area of the carrier elements 9, into which the carrier elements 9 pass under with a clearance.

Magnets 6, 7 each designed as a cylindrical permanent magnet are affixed below the plate 11 on both sides of the recess 12 in the initial area of the sliding way in such fashion that the magnets upper front surface is located closely below the bottom surface of the sliding way 11. The two magnets 6, 7 are sufficiently strong in order to abruptly pull an unprocessed crown cap 3 downwardly against the initial area of the sliding way 11 from the recess 10 of a closure head 1 moving in the opposite direction to the force of the holding magnet 2. This is represented o the righthand side of FIG. 2. A further magnet 8 designed as a cylindrical permanent magnet rests centrally below the revolving path 19 of the recess 12 following the magnets 6, 7 in such a fashion that its upper front surface is closely below the bottom surface of the recess 12. A crown cap 3 attracted by the magnets 6, 7 is kept in further contact with the inclined sliding way 11 by this magnet 8, while the cap is advanced in the revolving direction by carrier element 9 passing under the recess 12. The lateral guide of the crown cap 3 is effected by the vertical lateral surfaces of the sliding way 11, which extend from the initial area located at a higher level up to the end area of the sliding path located at a lower level.

Beginning at the upper end f the area inclined to a greater extent, the sliding way 11 is provided at both longitudinal sides with parallel guide elements 13 and 14 in the form of narrow sheet metal strips engaging from above at the lower edge of the crown caps 3, which are secured to the plate 15. The guide elements 13 and 14 prevent a lifting of the crown caps 3 and the carrier elements freely travel between them. The guide elements 13 and 14 are extended beyond the lower end of the sliding way and extend arcuately downwardly through a passage opening 16 in the plate 15 in the area of the extension. The passage opening 16 is dimensioned sufficiently so as to make an unhindered passage of a crown cap 3 possible. A crown cap 3 is pushed across the stationary sliding way 11 from the carrier 9 of that closure head 1 from which it has been pulled off in the area of the magnets 6, 7 and 8. The conveying effect of the carrier element 9 continues beyond the influence of the magnet 8 until the crown cap 3 has substantially left the range of influence of all magnets. The crown cap 3 kept down by the downwardly acting force of the guide elements 13 and 14 and its kinetic energy is transported further downwardly on the sliding way 11 and through the passage opening 16 onto plate 15 and finally deflected by the bent ends of the guide elements 13 and 14 downwardly up to a collecting receptacle (not shown). These ends can also be provided with lateral guide surfaces for the crown caps 3.

I claim:

1. In a vessel closing apparatus for securing crown caps to vessels, said apparatus having at least one closure head for securing a crown cap to a vessel, said closure head revolving in a closed path and having a recessed portion within a lower portion of said closure head to receive a crown cap and, positioned within said lower portion of said closure head, a first magnetic holding means to hold said crown cap within said recessed portion prior to being secured to said vessel, crown cap stripping means for removing an unsecured crown cap from said recessed portion, said stripping means being disposed in said closing apparatus, relative to the direction of rotation of said closure head in said closed path, upstream of a crown cap feed means for feeding crown caps to said recessed portion of said closure head of said vessel closing apparatus, the improvement comprising said crown cap stripping means being positioned outside of said recessed portion of said closure head and comprising at least one magnetic stripping means disposed below the revolving path of said closure head, said magnetic stripping means having a stronger magnetic attraction for said crown cap in said recessed portion than the magnetic attraction of said first magnetic holding means for holding a crown cap within said recessed portion.

2. The apparatus according to claim 1, wherein each said closure head is provided with downwardly projecting cam-like carrier elements positioned at the lower portion of said closure head and on the side of said closure head opposite to the direction of movement of said closure head.

3. The apparatus according to claim 1, or 2, wherein said magnetic stripping means is fixedly disposed below the movement of the path of the crown caps while within said recessed portion of said closure head.

4. The apparatus according to claim 3, wherein at least one fixedly disposed magnetic stripping means is disposed respectively on both sides of the revolving path of said carrier elements.

5. The apparatus according to claim 4, wherein, relative to the revolving direction of said closure head, at least one additional magnetic stripping means is positioned centrally below the revolving path of said carrier elements and lateral to said magnetic stripping means, said additional magnetic shipping means fixedly disposed on both sides of said carrier elements.

6. The apparatus according to claim 1, wherein a stationary sliding way is provided in said vessel closing apparatus positioned concentrically and centrically relative to the revolving path of said closure head to receive crown caps removed by said magnetic striping means from said recessed portion of said closure head and positioned below the revolving path of said closure head.

7. The apparatus according to claim 6, wherein said magnetic stripping means is fixedly disposed closely below the surface of said sliding way or is in alignment with the surface of said sliding way.

8. The apparatus according to claim 6, wherein said sliding way is provided with a recess in the revolving area of said carrier elements.

9. The apparatus according to claim 6, wherein said sliding way extends at least partly obliquely downwardly relative to the revolving direction of said closure head.

10. The apparatus according to claim 6, wherein the sliding way is grove-shaped.

11. The apparatus according to claim 6, wherein said sliding way is provided on each of its longitudinal sides with guide elements means.

12. The apparatus according to claim 11, wherein said guide elements means extend downwardly in arched fashion away from the end of said sliding way.

13. The apparatus according to claim 11, wherein said guide elements means are parallel to each other.

14. The apparatus according to claim 6, wherein said sliding way is a plate disposed substantially horizontally relative to the direction of rotation of said closure head in said closed path, and said magnetic stripping means is fixed to said plate and said plate is provided with a opening sufficient for said crown caps stripped from said closure head to pass through an end area of said sliding way in communication with said crown cap feed means.

* * * * *